US006270052B1

(12) United States Patent
Mayo et al.

(10) Patent No.: US 6,270,052 B1
(45) Date of Patent: Aug. 7, 2001

(54) FORM FOR PRODUCING CONCRETE COLUMNS WITH RECESSED RINGS

(75) Inventors: Earl Mayo, Calcasieu, LA (US); Richard Cusick, Cass, IL (US); Mark Huneke; George Langstaff, both of St. Louis, MO (US)

(73) Assignee: Smurfit Stone Container Corp., Chicago, IL (US)

( * ) Notice: Subject to any disclaimer, the term of this patent is extended or adjusted under 35 U.S.C. 154(b) by 0 days.

(21) Appl. No.: 09/236,349

(22) Filed: Jan. 25, 1999

(51) Int. Cl.[7] ..... E04G 13/02

(52) U.S. Cl. ..... 249/48; 249/35; 52/721.2; 52/737.1

(58) Field of Search ..... 249/48, 49, 51, 249/52, 35; 52/745.17, 721.1, 721.2, 736.1, 737.1

(56) References Cited

U.S. PATENT DOCUMENTS

| | | | | |
|---|---|---|---|---|
| 1,224,584 | * | 5/1917 | Vogan | 249/48 |
| 1,398,412 | * | 11/1921 | Barkschat | 249/48 X |
| 1,429,220 | * | 9/1922 | Blanton | 249/48 |
| 1,750,511 | * | 3/1930 | Dunn | 249/52 |
| 2,677,165 | * | 5/1954 | Copenhaver et al. | 249/48 X |
| 2,914,833 | * | 12/1959 | Hart, Jr. et al. | 249/48 X |
| 3,301,926 | * | 1/1967 | Reiland | 249/48 |
| 3,375,623 | * | 4/1968 | Buhler | 249/35 X |
| 3,751,196 | * | 8/1973 | Cannon et al. | 249/48 |
| 3,979,100 | * | 9/1976 | Phillips | 249/48 |
| 3,990,672 | * | 11/1976 | Buchanan | 249/48 |
| 4,887,789 | * | 12/1989 | Harris et al. | 249/48 X |
| 4,957,270 | * | 9/1990 | Rummage et al. | 249/48 |

FOREIGN PATENT DOCUMENTS

| | | | | |
|---|---|---|---|---|
| 379929 | * | 9/1932 | (GB) | 249/35 |

* cited by examiner

*Primary Examiner*—Laura A. Callo
(74) *Attorney, Agent, or Firm*—Paul M. Denk

(57) ABSTRACT

A mold is provided for forming a concrete column having at least one recess formed therein, as molded. The mold includes a tubular housing having an inner surface and a recess form having an inner and an outer surface. The recess form is mountable in the housing at a desired location on the inner surface of the mold housing. The recess form is preferably generally a ring The ring's outer surface corresponds to the shape of the housing's inner surface so that, when the ring is mounted in the housing, there are substantially no gaps between the outer surface of the ring and the inner surface of the housing. The ring has a slice through it, so that the ring may be expanded and pried out of the groove or recess molded in the column once the cement has set. Preferably, the slice is off-set from a radial line drawn through the ring. The ring is secured in place in the mold using screws. Preferably, the housing and ring are made of fiberboard though which the fasteners can be driven without the need for pre-drilled holes.

7 Claims, 1 Drawing Sheet

FORM FOR PRODUCING CONCRETE COLUMNS WITH RECESSED RINGS

CROSS-REFERENCE TO RELATED APPLICATIONS

Not applicable.

STATEMENT REGARDING FEDERALLY SPONSORED RESEARCH OR DEVELOPMENT

Not Applicable.

BACKGROUND OF THE INVENTION

This invention relates to concrete column forms, and in particular, to a paperboard form or mold which enables a recessed ring to be easily formed in a poured concrete column.

Buildings often include concrete columns as architectural accents. To make the columns more aesthetically pleasing, various accents are added to the concrete columns. For example, columns have been made which have recessed rings or circumferential grooves. Columns with such rings or grooves are very time consuming and expensive to make. Further, the results are not consistent. Currently, such a column would be created by building a form (which defines the ring or groove) on site, and then pouring cement into the form so built. The construction of such forms is time consuming and expensive.

BRIEF SUMMARY OF THE INVENTION

Briefly stated, a mold is provided for forming a concrete column having at least one recess formed therein, as molded. The mold includes a tubular housing having an inner surface and a recess form having an inner and an outer surface. The housing can be formed from a spirally wound paperboard tubes. The recess form is mountable in the housing at a desired location on the inner surface of the mold housing. The recess form is preferably generally a ring. The ring's outer surface corresponds to the shape of the housing's inner surface so that, when the ring is mounted in the housing, there are substantially no gaps between the outer surface of the ring and the inner surface of the housing. The ring has a slice through it, so that the ring may be expanded and pried out of the groove or recess molded in the column once the cement has set. Preferably, the slice is off-set from a radial line drawn through the ring. The ring is secured in place in the mold using screws. Preferably, the housing and ring are made of fiberboard though which the fasteners can be driven without the need for pre-drilled holes.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes what we presently believe is the best mode of carrying out the invention.

Figure 1:
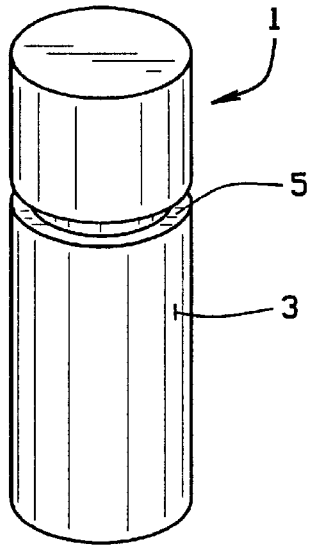
FIG. 1 is a perspective view of a column with a recessed ring formed using a form or mold of the present invention.

A column 1 is shown in FIG. 1 and includes an outer surface 3 and a circumferential groove or recess 5 formed in the column.

Figure 2:
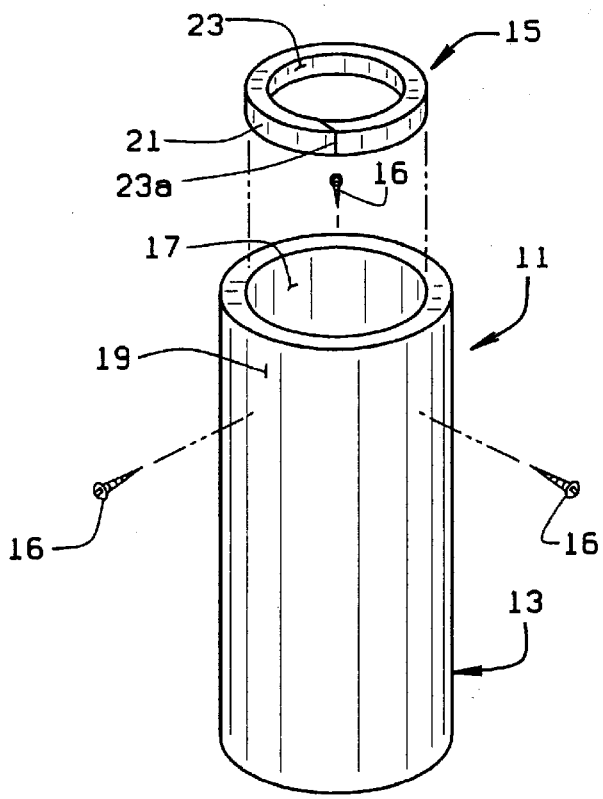
FIG. 2 is an exploded view of a concrete form or mold used to make the column of FIG. 1.
Figure 3:
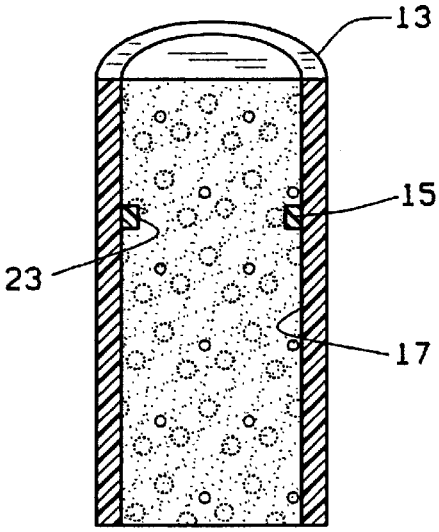
FIG. 3 is a cross-sectional view of the mold with concrete poured therein.

A mold or form 11 used for making the column with the molded recess is shown in FIG. 2. The mold 11 includes a tubular housing 13 and at least one ring 15. The housing 13 can be formed from continuously or spirally wound paperboard tubes. The ring 15 is independent of the housing 13 and is mounted within the housing 13 at a desired location along the axial length of the housing 13. The ring 15 is preferably secured in place using screws 16 which extend through the housing 13 and into the ring 15. Preferably, the housing and ring are both made of fiberboard or paperboard. This avoids the need for pre-drilled holes in the housing 13 and ring 15, and the screws 16 can be simply driven through the housing 13 and into the ring 15.

The housing 13 includes an inner surface 17 and an outer surface 19. The ring 15 similarly includes an outer surface 21 and an inner surface 23. The ring outer surface 21 is sized and shaped to correspond to the shape of the housing's inner surface 17 such that there is a snug fit between the ring and the housing with substantially no gaps between the ring's outer surface 21 and the housing's inner surface 17 when the ring 15 is secured in the housing. Additionally, the ring 15 includes a slit or cut 23A which extends fully through the ring (from its inner to its outer surfaces and from its top to bottom surfaces). Thus, the ring 15 can be expanded.

The production of the column 1 is quite simple and straight forward. The desired location of the ring in the column is determined, and the ring 15 is secured in the housing 13 at the desired location using the screws 16. Because the ring 15 fits snugly inside of the housing 13, the ring 15 can be pushed into place. The friction fit between the ring 15 and the housing 13 will hold the ring in place while the screws 16 are driven through the housing 13 into the ring 15 to hold the ring in place while concrete is poured into the form 11. FIG. 2 shows that three screws 16 are used to fasten the ring in the housing. However, fewer or more screws can be used, as desired. Because the housing 13 and ring 15 are made of fiberboard, holes do not have to be pre-drilled for the screws. Rather, the screws can be driven directly through the housing and ring. Once the ring 15 is secured in place in the housing 13, the housing is supported as necessary, as is known in the art. Cement or concrete is then poured into the mold 11. A release material is preferably liberally applied to the ring 15 prior to pouring of the cement or concrete into the mold 11. The release material can also be applied to the inner surface 17 of the housing 13.

After the concrete has been poured (and before it cures or sets), the mold 11 is vibrated, for example, by hitting the outside of the housing 13 or by using a vibrating tool. This will help the cement flow to contact all the exposed (upper, inner, and bottom) surfaces of the ring, so that the recess will be formed to correspond substantially to the desired shape.

That is, so that all corners of the recess will be sharp and all edges will be substantially smooth.

Figure 4:
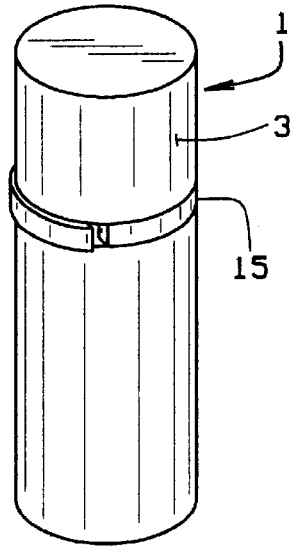
FIG. 4 is a perspective view of the concrete column after the cylindrical portion of the mold has been removed from the column, but before the ring portion of the mold has been removed from the column, the ring being pulled slightly from the recess formed in the column.

Once the cement or concrete has been allowed to cure for a desired period of time (for example 24 hours), the screws 16 are removed, and the tubular housing 13 is removed from the concrete column. This can be done, for example, by sawing an axial cut through the housing 13 and prying the housing 13 from around the formed column 1. The ring 15 remains on the column at this point, as shown in FIG. 4. The ring 15 is then pried from the groove 5. For example, a pry bar can be inserted into the ring cut 23A to pry the ring out of the groove. Once the ring 15 is removed from the groove 5, the column 1 can then be finished as needed.

Figure 5:
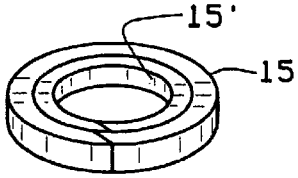
FIG. 5 is a perspective view of two concentric rings use to form a deeper recess.

Turning to FIG. 5, a two rings 15 and 15' can be positioned concentrically of each other to allow for a column to have a deeper recess. The same goal can be accomplished using a ring having a deeper annular wall. However, as the annular wall gets deeper, the ring becomes less flexible, and it becomes harder for the ring to be pried out of the groove once the column has been formed. When using two concentrically positioned rings, the two rings can be joined together prior to being inserted in the housing 13. Alternatively, the screws 16 can be sufficiently long to extend through the housing 13, the first ring 15, and into the second ring 15'.

Figure 6:
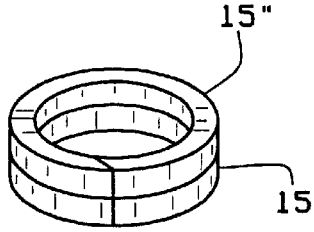
FIG. 6 is a perspective view of two stacked rings to form a taller recess.

Two rings 15 and 15" are shown stacked on top of each other in FIG. 6. This allows for the formation of a taller groove or recess 5. The use of multiple rings to form taller grooves gives the column designer the ability to make a column having a taller groove without having to actually stock a ring for each possible size of groove.

Although not shown, rings 15' could be placed inside of rings 15 and 15" to form a tall deep groove.

As can be appreciated, the two part mold 11 allows for an easy method of forming a column having a recess or groove molded therein. This, thus, eliminates the need, for example, of cutting a recess in an already formed column or building an expensive form or mold on site. Further, the column can be formed with two or more recesses or grooves. Additionally, the mold is easily formed off-site, and then easily assembled on site. Thus, the difficulty in forming molds on site is substantially eliminated.

As various changes could be made in the above constructions without departing from the scope of the invention, it is intended that all matter contained in the above description or shown in the accompanying drawings shall be interpreted as illustrative and not in a limiting sense. Although the housing is shown to be cylindrical, the housing does not need to be a cylindrical tube. The tube can have any desired shape (polygonal or otherwise). Similarly, although the ring is shown to have a circular inner surface, the ring inner surface can be formed to have any desired shape (polygonal or otherwise). The top and bottom surfaces of the ring do not need to be flat, as shown in the drawings. Additionally, the same concept can be used to form a groove which spirals around the column or which simply extends longitudinally along the surface of the column. Further, rather than separately removing the ring 15 from the column after the housing 13 has been removed, the housing 13 and ring 15 can be removed from the set column together. These examples are merely illustrative.

What is claimed is:

1. A mold for forming a concrete column having at least one recess formed therein; the mold including a circumferentially continuous tubular housing having an inner surface and a recess form having an inner and an outer surface; the recess form being mountable in the housing at a desired location on the inner surface of the mold housing and having a length less than the length of the tubular housing; whereby, when the recess form is mounted in the housing, there are substantially no gaps between the outer surface of the recess form and the inner surface of the housing.

2. The mold of claim 1 wherein the recess form defines a ring having an inner surface and an outer surface; the ring outer surface being sized and shaped to correspond to the shape of the tubular housing inner surface.

3. The mold of claim 2 wherein the ring includes a slice extending from its outer surface to its inner surface.

4. The mold of claim 3 wherein the ring slice extends radially through the ring.

5. The mold of claim 1 including fasteners; each fastener extending through the housing and into the recess form to mount the recess form in the housing at the desired location, and said fasteners comprising screws.

6. The mold of claim 5 wherein the housing and recess form are made of fiberboard though which the fasteners can be driven without the need for pre-drilled holes.

7. The mold of claim 6 wherein the circumferentially continous tubular housing is formed from one of a convolutely and spirally wound paperboard tube.

* * * * *